US011751738B2

(12) United States Patent
Kim

(10) Patent No.: US 11,751,738 B2
(45) Date of Patent: Sep. 12, 2023

(54) CLEANER

(71) Applicant: LG ELECTRONICS INC., Seoul (KR)

(72) Inventor: Yongwoo Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 471 days.

(21) Appl. No.: 16/891,399

(22) Filed: Jun. 3, 2020

(65) Prior Publication Data

US 2020/0383536 A1 Dec. 10, 2020

(30) Foreign Application Priority Data

Jun. 4, 2019 (KR) ..... 10-2019-0065656

(51) Int. Cl.
*A47L 9/04* (2006.01)
*A47L 5/36* (2006.01)
(Continued)

(52) U.S. Cl.
CPC ..... *A47L 9/0477* (2013.01); *A46B 9/026* (2013.01); *A46B 13/001* (2013.01); *A46B 13/02* (2013.01);
(Continued)

(58) Field of Classification Search
CPC ..... A47L 9/0477; A47L 5/362; A47L 9/0455; A47L 9/0488; A47L 9/0427; A47L 9/066;
(Continued)

(56) References Cited

U.S. PATENT DOCUMENTS 4,287,064 A * 9/1981 Ando ..... B01D 29/6423 209/390

FOREIGN PATENT DOCUMENTS

KR 10-2005-0078422 8/2005
KR 10-2006-0077393 7/2006
(Continued)

OTHER PUBLICATIONS

Notice of Allowance, dated Sep. 7, 2021, issued in Korean Patent Application No. 10-2019-0065656 (2 pages).
(Continued)

*Primary Examiner* — Anne M Kozak
*Assistant Examiner* — Christopher Soto
(74) *Attorney, Agent, or Firm* — Birch, Stewart, Kolasch & Birch, LLP

(57) ABSTRACT

A cleaner includes a case having an opening formed in a lower side. The cleaner also includes a brush assembly disposed inside the case. The brush assembly includes a horizontally disposed brush bar and a brush coupled to the brush bar. The cleaner includes a suction port for suctioning dust collected by the brush assembly. The cleaner also includes a motor that provides power to the brush assembly. Further, the cleaner includes an operation assembly, connecting the motor and the brush assembly, and converting a rotational movement of the motor into a translational motion of the brush assembly. The operation assembly includes a rotating member coupled to a shaft of the motor, a link connected to the rotating member, a connecting member connecting the brush bar and the link, and a guide rail for guiding the connecting member in a longitudinal direction.

13 Claims, 13 Drawing Sheets

(51) Int. Cl.
*A46B 9/02* (2006.01)
*A46B 13/00* (2006.01)
*A46B 13/02* (2006.01)

(52) U.S. Cl.
CPC ..... *A47L 5/362* (2013.01); *A47L 9/0411* (2013.01); *A47L 9/0455* (2013.01); *A47L 9/0488* (2013.01); *A46B 2200/30* (2013.01)

(58) Field of Classification Search
CPC ..... A47L 9/0483; A47L 9/0466; A46B 9/026; A46B 13/001; A46B 13/02; A46B 2200/30
See application file for complete search history.

(56) References Cited

FOREIGN PATENT DOCUMENTS

| | | |
|---|---|---|
| KR | 10-0638205 | 10/2006 |
| KR | 10-0778070 | 11/2007 |

OTHER PUBLICATIONS

Korean Office Action, dated Apr. 23, 2021, issued in Korean Patent Application No. 10-2019-0065656 (3 pages).
Korean Office Action, dated Sep. 28, 2020, issued in Korean Patent Application No. 10-2019-0065656 (4 pages).

* cited by examiner

CLEANER

BACKGROUND

1. Technical Field

The present disclosure relates to a cleaner, and more particularly, to a cleaner having a moving device for translational motion moving the brush.

2. Description of the Related Art

A cleaner is an apparatus for suctioning and cleaning external dust according to a pressure difference, and there are various apparatuses having an electric motor including a vacuum cleaner and a robot cleaner.

FIG. 1 is a perspective view showing a shape of a general vacuum cleaner 1. In general, the vacuum cleaner is composed of a main body 3 that compresses air to generate suction power, a suction device 5 that suctions dust using the suction power of the main body, and a connecting hose 7 that connects the main body and the suction device.

Since the main body 3 includes a compressor that compresses air, when the vacuum cleaner 1 is operated, the compressor operates and the internal pressure of the main body is rapidly lowered. This suction force is transmitted to the suction device 5 through the connecting hose 7. Dust is suctioned into the suction device 5 due to a pressure difference, and the dust is sent to the main body 3 through the connecting hose 7.

Since the main body 3 includes a dust bag, the dust suctioned by the suction device 5 is stored in the dust bag. The dust stored in the dust bag can be separated from the main body 3 and shaken off.

The connecting hose 7 is in the form of a pipe connecting the main body 3 and the suction device 5, and transfers the dust suctioned by the suction device 5 to the dust bag of the main body 3 when the internal pressure of the main body 3 is lowered. The connecting hose 7 connected to the main body 3 is formed of a flexible corrugated pipe so that it can be easily moved, and the connecting hose 7 connected to the suction device 5 is made of a rigid body having no elasticity, so that the suction device 5 can be moved to a desired place.

The suction device 5 has a lower portion that is opened to suction dust and send it to the connecting hose 7. An inlet of the suction device 5 has various shapes.

The conventional vacuum cleaner 1 is provided with a brush around an opening part of the suction device. When disposed in the front end of the inlet, the brush serves to make it easier to suction the dust from a suction portion by scraping off the dust that is adhered to the floor. When the brush is disposed in the rear end of the inlet, it serves to finish by sweeping the area where the suction portion has passed.

Some vacuum cleaners facilitate cleaning of a protrusion portion or a corner portion by installing a roller that moves flexibly in the front side of the brush. That is, such apparatuses may install a roller that is rotated by a motor as a driving source and moves flexibly in the longitudinal direction on the bottom surface of a brush body connected to an extension pipe by linearly connecting a plurality of rollers, thereby easily cleaning the dust and foreign matter of a protrusion portion or a corner portion. However, such apparatuses should install brushes over the entire outer circumferential surface of the roller, the number of brush installations is increased. Accordingly, there occurs an economic problem. Further, if the roller is deformed, the displacement also must be considered. Accordingly, it is difficult to clean in a small place because the size of a suction portion is large.

Some suction device is as shown in FIG. 2. However, the apparatus also does not solve the economic problem of installing the brush over the entire outer circumferential surface of the roller, and does not solve the problem that the size of the suction portion is increased by having a roller-type brush assembly.

SUMMARY

The present disclosure has been made in view of the above problems, and provides a cleaner having a high cleaning efficiency while using a small number of brushes.

The present disclosure further provides a cleaner having a large cleaning area.

The present disclosure further provides a cleaner having a low suction device.

In order to achieve the above object, the cleaner according to the present disclosure includes a brush assembly having a brush for collecting dust, and an operating assembly for transmitting power of the motor to the brush assembly to perform translational movement, wherein the brush assembly moves rearward from front to collect dust.

The brush assembly includes a brush and a brush bar to which the brush is coupled and extends laterally.

The operating assembly includes a rotating member coupled to the shaft of the motor, a link connected to the distal end of the rotating member, a connecting member rotatably connected to the link and coupled to the distal end of the brush bar, a protrusion protruding from the connecting member, and a guide rail into which the protrusion is inserted.

Accordingly, the protrusion is inserted into the guide rail to perform a sliding motion, and accordingly the connecting member and the brush unit perform translational motion to sweep out the dust.

The guide rail may include a horizontal rail and a slope rail, and a place where the horizontal rail meets the slope rail may be bent, and the horizontal motion and the slope motion may be repeated to continuously sweep dust.

The guide rail may include a rail side surface, an internal protrusion portion protruding from the inside of the rail side, and an external protrusion portion protruding from the outside of the rail side surface. At this time, since the height of the side end of the inner protrusion portion is higher than the height of the side end of the inner protrusion portion, the protrusion that has completed the horizontal movement rises finely along the curved surface, and when starting the slope movement, it does not return to horizontal but perform the slope movement.

The side surface of the guide rail may include a slope guide disposed to connect with the slope surface of the slope rail, and the protrusion that has completed the horizontal movement can easily perform the slope movement along the slope guide.

BRIEF DESCRIPTION OF THE DRAWINGS

The above and other objects, features and advantages of the present disclosure will be more apparent from the following detailed description in conjunction with the accompanying drawings, in which.

DETAILED DESCRIPTION

Figure 1:
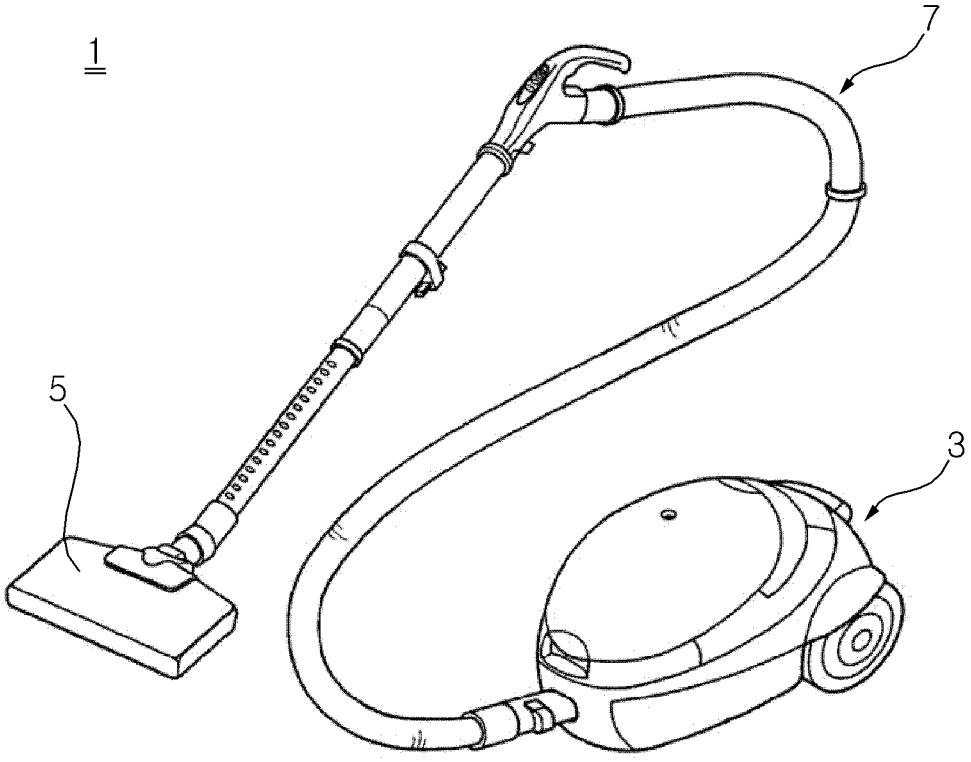
FIG. 1 is a schematic perspective view of a cleaner.
Figure 2:
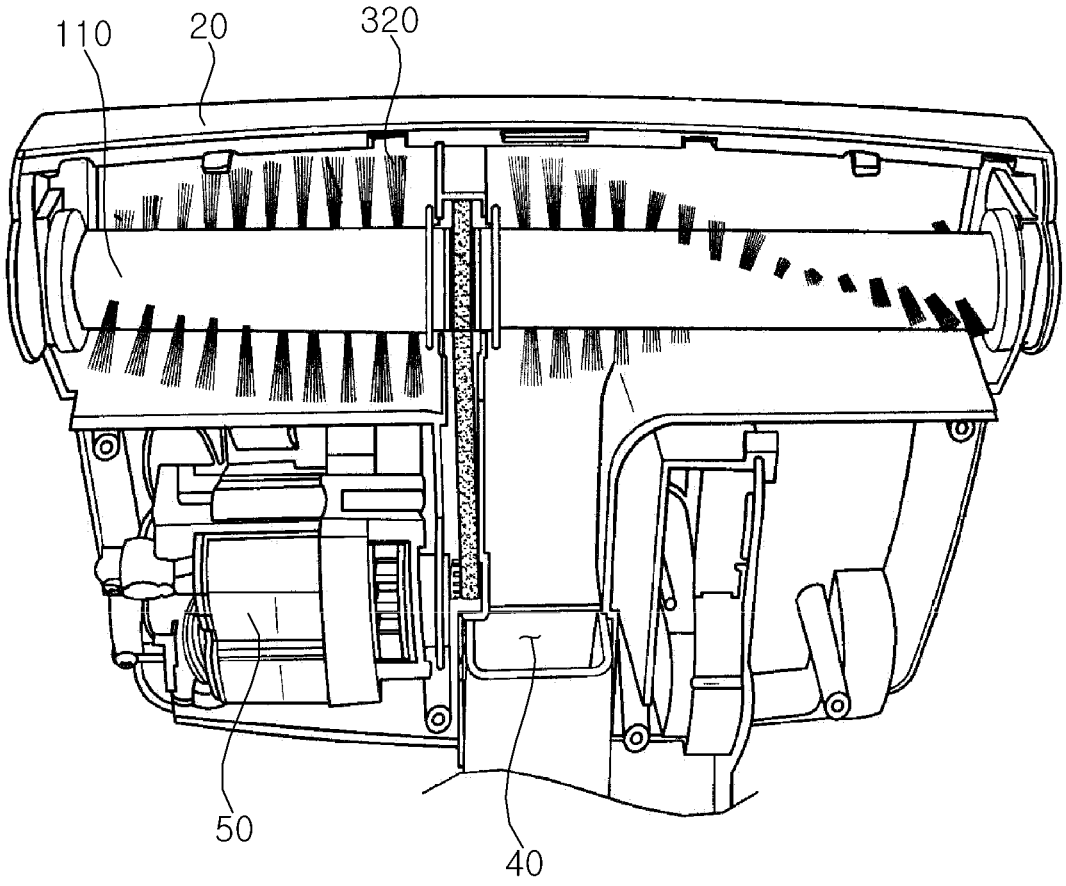
FIG. 2 is a bottom view of a typical cleaner suction device.

Advantages and features of the present disclosure and methods for achieving them will be made clear from the embodiments described below in detail with reference to the accompanying drawings. The present disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art. The present disclosure is defined only by the scope of the claims. Like reference numerals refer to like elements throughout the specification.

Hereinafter, the present disclosure will be described with reference to the drawings for explaining a cleaner according to embodiments of the present disclosure.

The main components will be described with reference to FIG. 3.

The cleaner according to the present disclosure includes a case 20, a brush assembly 30, an operation assembly 10, a suction port 40, and a motor 50. The case 20 may form an outer shape, and form a space therein so that components can be disposed. The brush assembly 30 is provided with a brush in one side, and serves to sweep away the dust existing in the floor. The operation assembly 10 has one side connected to the brush assembly 30 and the other side connected to the motor 50, and serves to move the brush assembly 30 by transmitting power of the motor 50 to the brush assembly 30. The suction port 40 is a configuration corresponding to the brush assembly 30, and is a component that suctions the dust swept off by the brush assembly 30. The motor 50 is a component providing a driving force for moving the brush assembly 30.

The case 20 may form an outer shape, form a space therein so that components can be disposed, and have a lower portion that is opened to perform cleaning. The shape of the case 20 may be in the form of a quadrangle as shown in FIG. 3, but is not necessarily limited to the present description, and includes a change that can be easily performed by a person skilled in the art. The case 20 may be disposed in the bottom surface of the robot cleaner to perform cleaning operation, and may be disposed in the suction device of the cleaner to perform cleaning operation.

The suction port 40 is a component that suctions dust by negative pressure, and forms an opening in a position opposite to the brush assembly 30. The size of the opening of the suction port 40 may be formed larger than the width at which the brush is disposed. The suction port 40 is disposed in the rear side of the brush as shown in FIG. 3 so that the brush may suction dust collected from the front.

The brush assembly 30 is a component that includes the brush 320, and is a component that serves to sweep dust on the floor and collect it into the suction port 40. The brush assembly 30 includes a brush bar 310 and a brush 320.

The brush bar 310 is formed of a long bar, and may include a plurality of cleaning brushes or wires at the bottom thereof, and transfers dust to the suction port 40 by brushing. Preferably, the brush bar 310 is formed horizontally and can move forward/backward.

The suction port 40 serves to suction dust transferred by the brush 320 in the brush assembly 30. Since the suction port 40 has an opening in a surface where the brush assembly 30 is disposed, it suctions the dust transferred by the brush 320. The width of the suction port 40 is preferably wider than the width of the brush disposed in the brush assembly 30, which is intended to suction the dust transferred by the brush as much as possible.

Figure 4A:
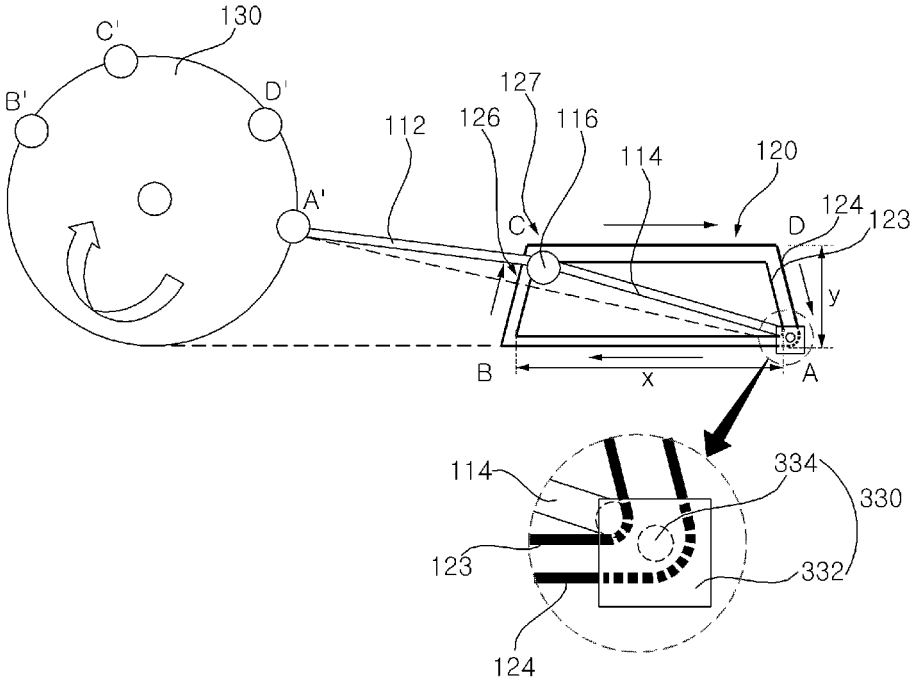
FIGS. 4A and 4B are a side view showing a process of the brush moving device of the cleaner according to the first embodiment of the present disclosure when viewed at points A and B.
Figure 4B:
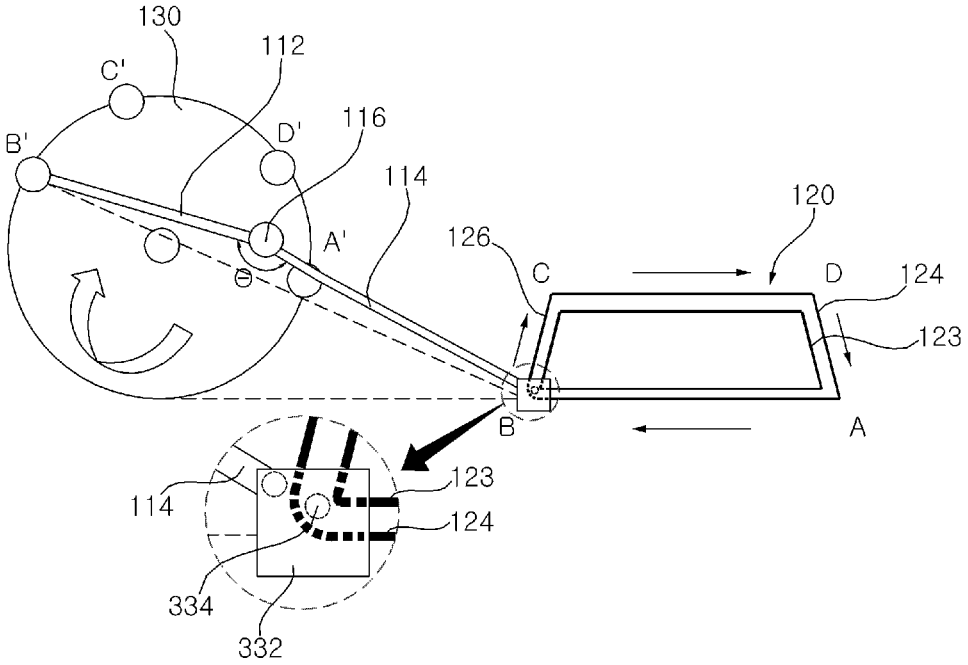
Figure 5:
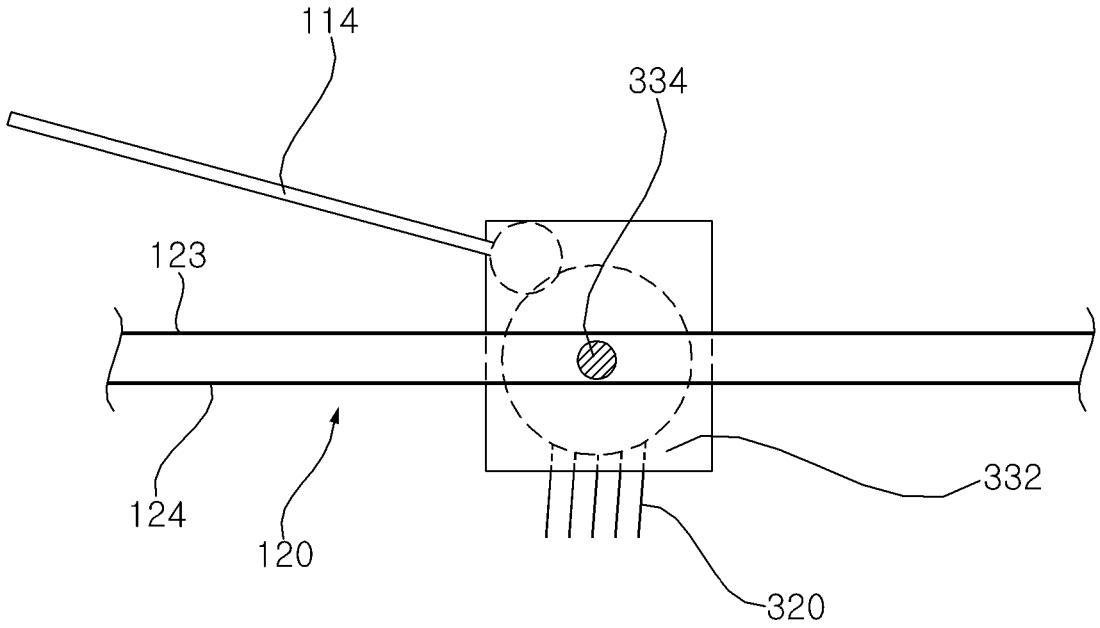
FIG. 5 is a side view schematically showing a connection structure of a guide rail and a protrusion according to the first embodiment of the present disclosure.

The configuration of the operation assembly 10 will be described with reference to the drawings shown in FIGS. 3 to 5.

The operation assembly 10 includes a rotating member 130 coupled to the shaft of a motor to perform rotational movement, a link 110 rotatably connected to the rotating member, a connecting member 330 coupled to a brush bar, and a guide rail serves to guide during the movement of the connecting member. The operation assembly 10 converts the rotational movement of the motor 50 to the translational motion of the brush assembly 30.

The rotating member 130 is coupled to the shaft of the motor 50 to perform a circular movement, and since the stroke distance of the brush assembly 30 is determined by the diameter of the rotating member 130, the stroke distance of the translational motion can be secured. That is, referring to FIGS. 4A and 4B, the link moves A~B by a distance difference between A' and B' of the rotating member 130, thereby sweeping and collecting dust.

The link 110 may include a first link 112 connecting a connecting pin 116 and the rotating member 130, and a second link 114 connecting the connecting pin 116 and a connecting body 332. The rotating member and the first link, the first link and the connecting pin, the connecting pin and the second link, and the second link and the connecting body are rotatably connected. When the link 110 is configured be separated into the first link 112 and the second link 114, the length of arm can be varied, thereby enabling various movements and increasing the stroke distance. In addition, if the motor assembly 50 is continuously operating when the brush assembly 30 has a malfunction and cannot be moved, serious damage may be caused to the motor 50 or the link 110. However, when separated into the first link 112 and the second link 114, there is an effect that damage to parts can be prevented as both arms are folded.

The connecting member 330 is coupled to the distal end of the brush bar 310. The connecting member 330 may be integrally formed with the brush bar 310, and may be separately formed and combined. The connecting member 330 may be coupled to both ends of the brush bar 310, as shown in FIG. 3, or may be coupled to one end. When viewed from the side, the connecting member 330 may have a quadrangular shape as shown in FIG. 3, but is not necessarily limited to the present description, and includes a change that can be easily performed by a person skilled in the art.

The connecting member 330 may include a connecting body 332 coupled to the distal end of the brush bar, and a protrusion 334 protruding from the connecting body. Preferably, the distal end of the brush bar 310 may be coupled to the inner surface of the connecting body 332, and the protrusion may protrude from the outer surface of the connecting body.

The protrusion 334 is a component that guides the brush bar 310 to have a certain movement, and is formed to protrude from one side of the connecting member 330. The protrusion 334 may be disposed to be parallel to the central axis of the brush bar 310. Preferably, the central axis of the protrusion 334 may coincide with the central axis of the brush bar 310 and the central axis of the connecting member 330. The protrusion 334 is inserted into a guide rail 120, which will be described below, to perform a sliding movement, thereby allowing the brush bar 310 to accomplish a certain movement.

Figure 3:
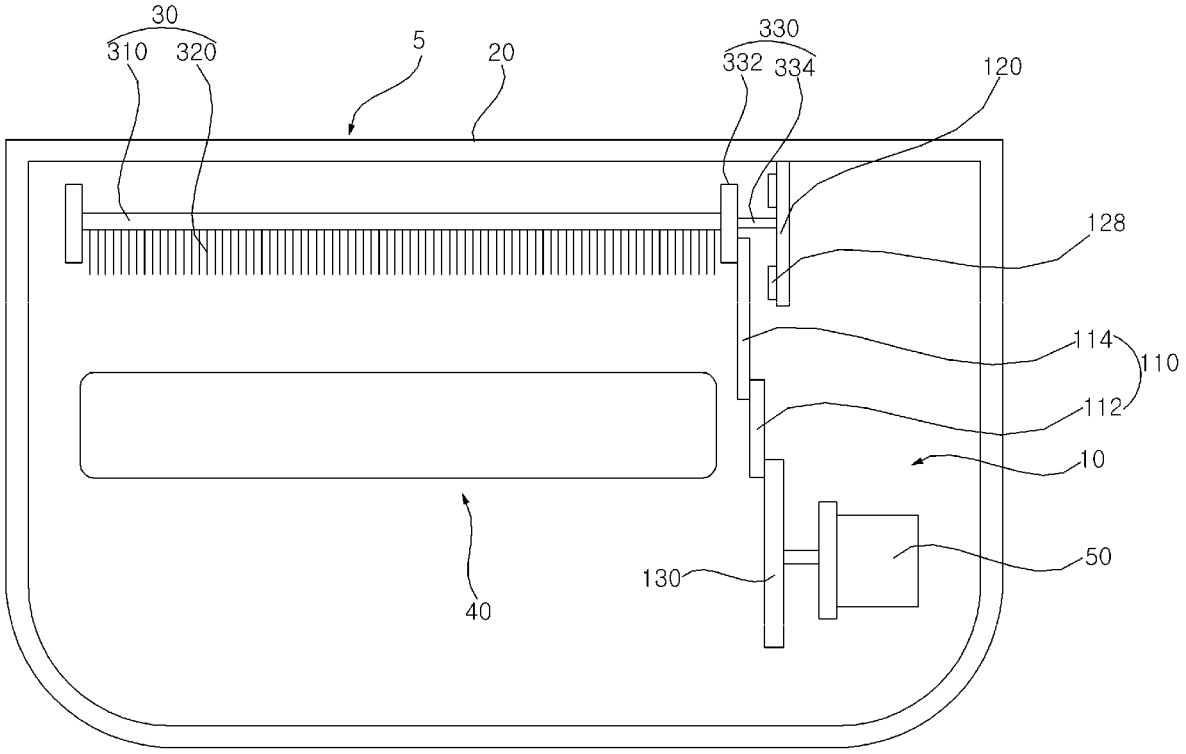
FIG. 3 is a schematic bottom view of a brush moving device of a cleaner according to a first embodiment of the present disclosure.

The protrusion 334 may be formed in one side of the connecting member 330 as shown in FIG. 3, but may also be formed in both sides. The protrusion 334 may be formed only in the connecting body 332 in the side where the operation assembly 10 and the motor 50 are disposed, as shown in FIG. 3, but may be formed in the opposite connecting body 332, or may be formed in both connecting bodies. However, since it is preferable to dispose the action point close to the force point in order to minimize the bending stress, it is preferable to be formed to extend from the connecting body 332 in the side where the operation assembly 10 and the motor 50 are disposed.

The position where the link 110 and the connecting body 332 are connected may be higher than the position where the protrusion 331 is coupled to the connecting body 332. It has an effect of preventing the free rotation of the connecting member 330 and the brush assembly 30 by having two action points, and referring to FIG. 5, when switching from a point B to a section BC, the brush bar 310 rotates clockwise to shake off the remaining dust to the suction port 40.

Figure 6:
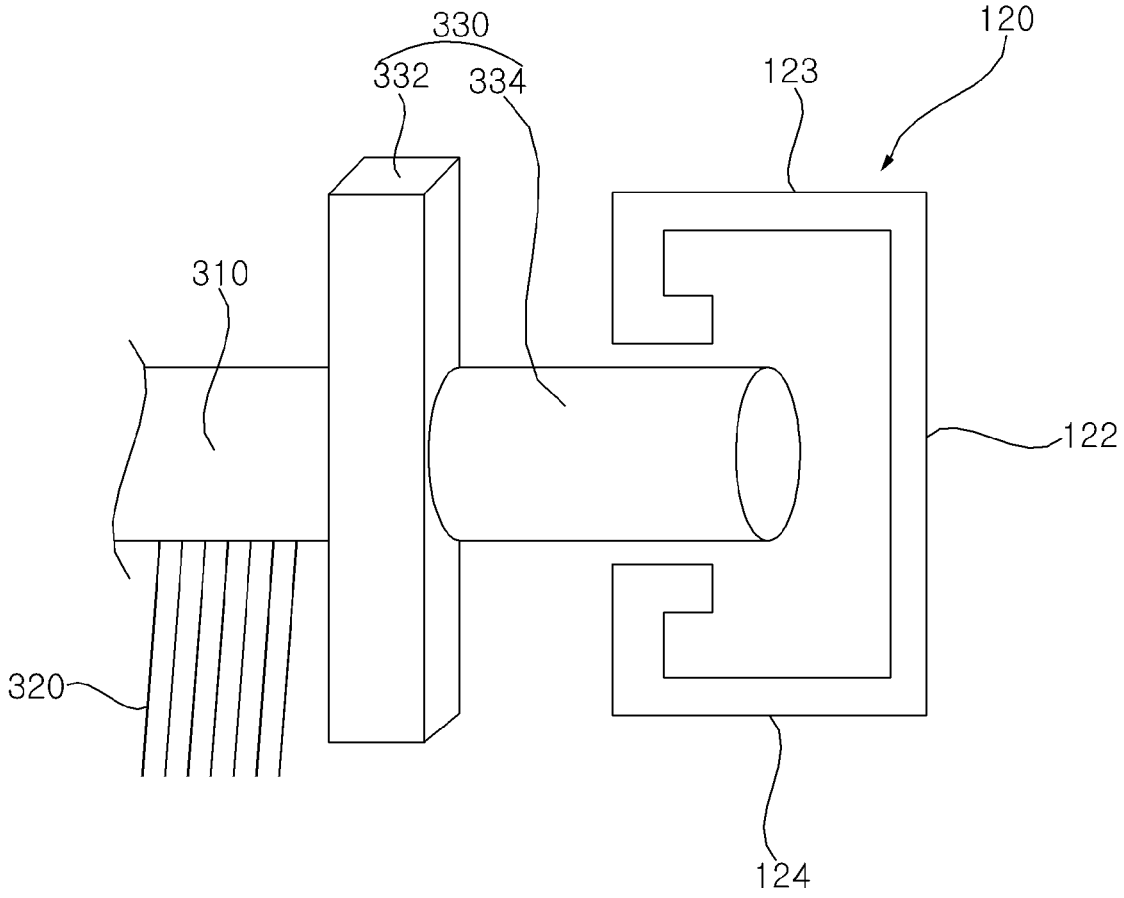
FIG. 6 is a front cross-sectional view showing a connection structure of the protrusion and the guide rail according to the first embodiment of the present disclosure.

The guide rail 120 will be described with reference to FIGS. 5 and 6.

The guide rail 120 may be disposed inside the front surface of the case 20. The guide rail 120 may slide the protrusion 334 to perform a translational motion. The guide rail may be provided only in one side of the brush assembly 30 as shown in FIG. 3, or provided in both sides of the brush assembly 30 to stably move the protrusion 334.

The guide rail 120 may include a rail side portion 122 which is disposed spaced apart from the outside of the distal end of the protrusion 334 and extended in the progress direction of the brush assembly 30, an inner protrusion portion 123 which protrudes from the inside of the rail side portion 122 and is adjacent to the inside of the protrusion 334, and an outer protrusion portion 124 which protrudes from the outside of the rail side portion 122 and is adjacent to the outside of the protrusion 334. The inner protrusion portion 123 and the outer protrusion portion 124 may face each other. That is, the inner protrusion portion 123, the rail side portion 122, and the outer protrusion portion 124 may be formed in a "U" shape. The protrusion 334 is inserted into the guide rail 120 and slides along the inner protrusion portion 123 and the outer protrusion portion 124.

Referring to FIG. 4, the guide rail 120 may be formed in a trapezoidal shape, and may be classified into a section AB that is a dust collecting step S1 of collecting foreign matters in the suction port 40 by moving the front brush assembly 30 to the suction port 40 parallel, a section BC that is a separation step S2 of separating foreign matters from the brush by raising the brush assembly 30, a section CD that is a horizontal restoring step S3 of restoring the brush assembly 30 by moving parallel, and a section DA that is a vertical restoring step S4 of preparing the dust collecting step by lowering the brush assembly 30. However, the present disclosure is not necessarily limited to this description, and includes changes that can be easily performed by a person skilled in the art.

The guide rail 120 may include a horizontal rail 127 disposed horizontally and a slope rail 126 disposed with a slope. For example, the guide rail corresponding to the section AB that is the dust collecting step S1 and the section CD that is the horizontal restoring step S3 are classified as the horizontal rail 127, and the guide rail corresponding to the section BC that is the separation step S2 and the section DA that is the vertical restoring step S4 may be classified as the slope rail 126. Therefore, the guide rail 120 of the present disclosure includes at least one slope rail 126 and at least one horizontal rail 127 so as to accomplish a circular movement.

Figure 7A:
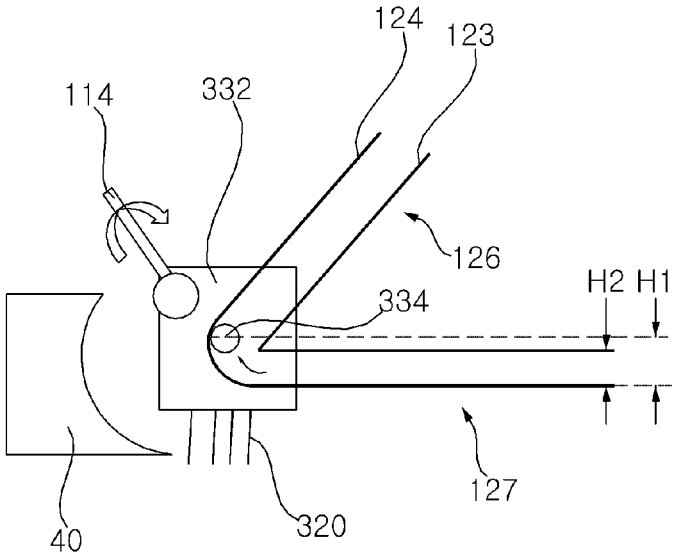
FIGS. 7A and 7B are a state diagram showing the movement of the protrusion at point B according to the first embodiment of the present disclosure.
Figure 7B:
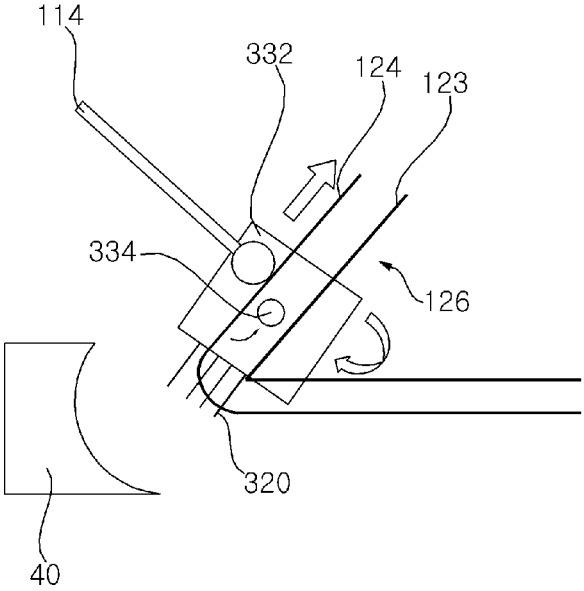
Figure 8:
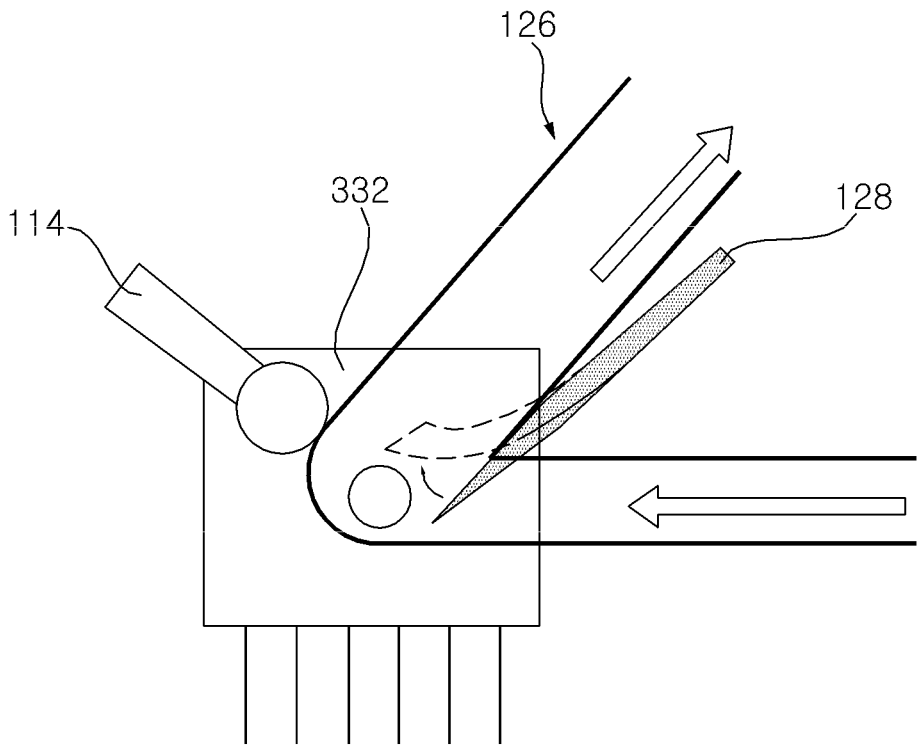
FIG. 8 is a side view of a brush moving device of a cleaner equipped with a slope guide according to the first embodiment of the present disclosure.

Referring to FIG. 7, a place where the slope rail 126 of the guide rail meets the horizontal rail may include a bent portion or a curved portion so as to smoothly change the traveling direction and to move to the next step easily without returning in the reverse direction. Preferably, when the slope rail starts from the distal end of the bent portion or curved portion, the height H1 of the distal end of the side surface of the outer protrusion portion in the bent portion or curved portion at the bottom end of the guide rail may be higher than the height H2 of the distal end of the side surface of the inner protrusion portion. Therefore, when reaching the distal end of the dust collecting step S1, the protrusion 334 rises by H2 along the outer protrusion portion of the bent portion (see FIG. 7A), and when the separation step S2 is started, the protrusion 334 comes into contact with the inner protrusion portion of the slope rail (see FIG. 7B), so that the protrusion 334 may rise along the slope.

Meanwhile, referring to FIG. 4, the vertical height y of the guide rail can be defined as the height of the slope rail, or as the height of the lower horizontal rail and the upper horizontal rail. In addition, the horizontal distance x of the guide rail can be defined as the horizontal distance between the bottom end of the front slope rail and the bottom end of the rear slope rail. According to the present disclosure, the vertical height y of the guide rail and the horizontal distance x of the guide rail can be independently designed. Accordingly, there is an effect of widening the cleaning area by increasing the horizontal distance and lowering the height of the suction device 5 by reducing the vertical height.

The slope guide 128 will be described with reference to the drawing shown in FIG. 6.

The slope guide 128 is a device that helps the protrusion 334 to rise along the slope rail 126 of the guide rail after moving horizontally, and the slope guide 128 may be disposed inside the guide rail 120 of point B. The slope guide 128 may be disposed downward as it progresses from point A to point B, and may preferably be connected to the inclined surface of the slope rail. The slope guide 128 does not interfere with the movement when the protrusion 334 moves from point A to point B in the dust collecting step S1, and when the separation step S2 begins, allows the protrusion 334 to slide along the slope of the slope guide 128 and to be seated in the slope rail 126 of the section BC.

The slope guide 128 may include an elastic body. If the slope guide 128 is formed of a material having no elasticity, there is a risk that the progress of the protrusion 334 may be prevented in the section AB and the protrusion 334 may be damaged. Therefore, the slope guide 128 should contain an elastic body, so that in the section AB, the protrusion 334 is elastically deformed so as to progress smoothly, thereby preventing the protrusion 334 from being damaged.

As shown in FIG. 3, the slope guide 128 may be disposed in point A, and may be disposed downwardly as it progresses from point D to point A, and preferably disposed parallel to the inclined surface of the DA slope rail.

Figure 9A:
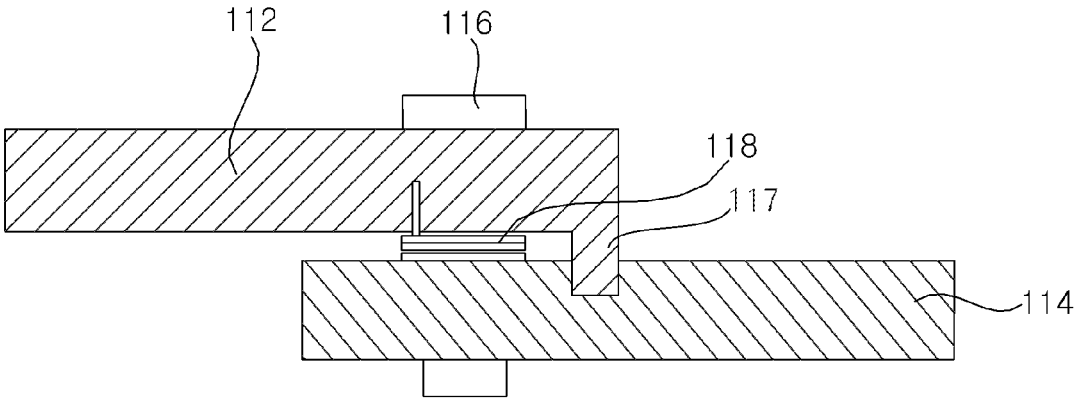
FIGS. 9A and 9B are a plan view and a side view showing a connection portion of a link according to the first embodiment of the present disclosure.
Figure 9B:
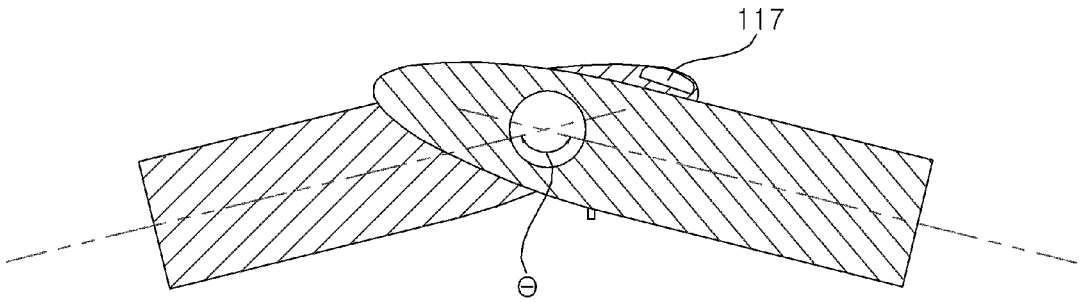

A stopper 117 will be described with reference to FIG. 9.

The link 110 includes the stopper 117 protruding from the first link 112 or the second link 114, and the angle θ of the first link 112 and the second link 114 may not exceed 180 degrees. If the angle θ of the link 110 becomes exactly 180 degrees, there is a problem in that the parts are damaged because the shock cannot be absorbed. Hence, the stopper 117 is included so that the angle θ of the link 110 does not become 180. Therefore, there is an effect of preventing damage to parts.

The stopper 117 may be disposed in the lower portion of the link 110 so that the link 110 is folded downward. Preferably, the stopper 117 may be disposed in the upper portion of the link 110 so that the link 110 is folded upward.

A spring 118 of arm will be described with reference to FIG. 9.

When the link 110 is folded, the spring 118 may be included in order to be restored, and preferably, a spring 118 may be included in a connection portion between the first link 112 and the second link 114. Referring to FIG. 9, the spring 118 of the present embodiment is a torsion spring, and may be disposed to be wound around the connecting pin 116.

Referring to FIG. 4, in the section AB which is the dust collecting step S1, a tensile force acts on the brush assembly 30 through the link 110 to move the brush assembly 30 to the B point. In the case of the BCD section, if there is no particular component, compression force for moving the brush assembly 30 does not occur. Accordingly, the spring 118 may be included to restore the folded link 110, thereby providing a force for moving the brush assembly 30. The restoring force guides the brush assembly 30 to point A via point C and point D.

The operation according to the present disclosure will be described for each section.

The section AB is a section corresponding to the dust collecting step S1 of collecting foreign matter in the suction port 40 by moving the brush assembly 30 to the suction port 40 parallel, and the movement section of the rotating member 130 corresponding to the section AB corresponds to A'~B'. In this section, the tensile force is applied to the link 110 as the rotating member 130 moves. Accordingly, the connecting member 330 is pulled to the point B, and the protrusion 334 moves to the point B along the guide rail 120.

The movement direction of the brush assembly 30 is shifted upwardly from point B to point C. If the rotational direction of the rotating member 130 is clockwise, the direction of movement of the rotating member 130 and the link 110 at B' is directed toward the point C which is the direction of the tangent, and the protrusion 334 is also directed toward the point C at point B corresponding to B', so that it can naturally move along the guide rail 120 of the BC section. In addition, as the slope guide 122 is included to prevent reverse driving to the point A, it is possible to move to the section BC.

The section BC is a section corresponding to the separating step S2 of separating foreign matter from the brush 320 by raising the brush assembly 30. In this section, as the rotating member 130 moves, a compressive force is applied to the link 110, the protrusion 334 moves upward to the point C along the guide rail 120 of the section BC, and the connecting member 330 rotates at a certain angle clockwise to remove dust from the brush.

The section CD is a section corresponding to the horizontal restoring step S3 of restoring the brush assembly 30 by moving parallel. In this section, as the rotating member 130 moves to C'~D', a compressive force is applied to the link 110, and the protrusion 334 moves horizontally to the point D along the guide rail 120 of the section CD.

The section DA is a section corresponding to the vertical restoring step S4 of preparing the dust collecting step S1 by lowering the brush assembly 30. In this section, since the rotating member 130 moves downward from D'~A', and a compressive force is applied to the link 110, the protrusion 334 moves downward to point A along the guide rail 120 of the section DA.

The movement direction of the brush assembly 30 is shifted backward from point A to point B. If the rotational direction of the rotational member 130 is clockwise, the movement direction of the rotating member 130 and the link 110 at B' is directed toward the floor which is the direction of the tangent, so that there is no risk that the protrusion 334 travels backward to point D. In addition, since the tensile force is applied to the link 110 while passing through A', it can naturally move along the guide rail 120 of the section BC.

Figure 10:
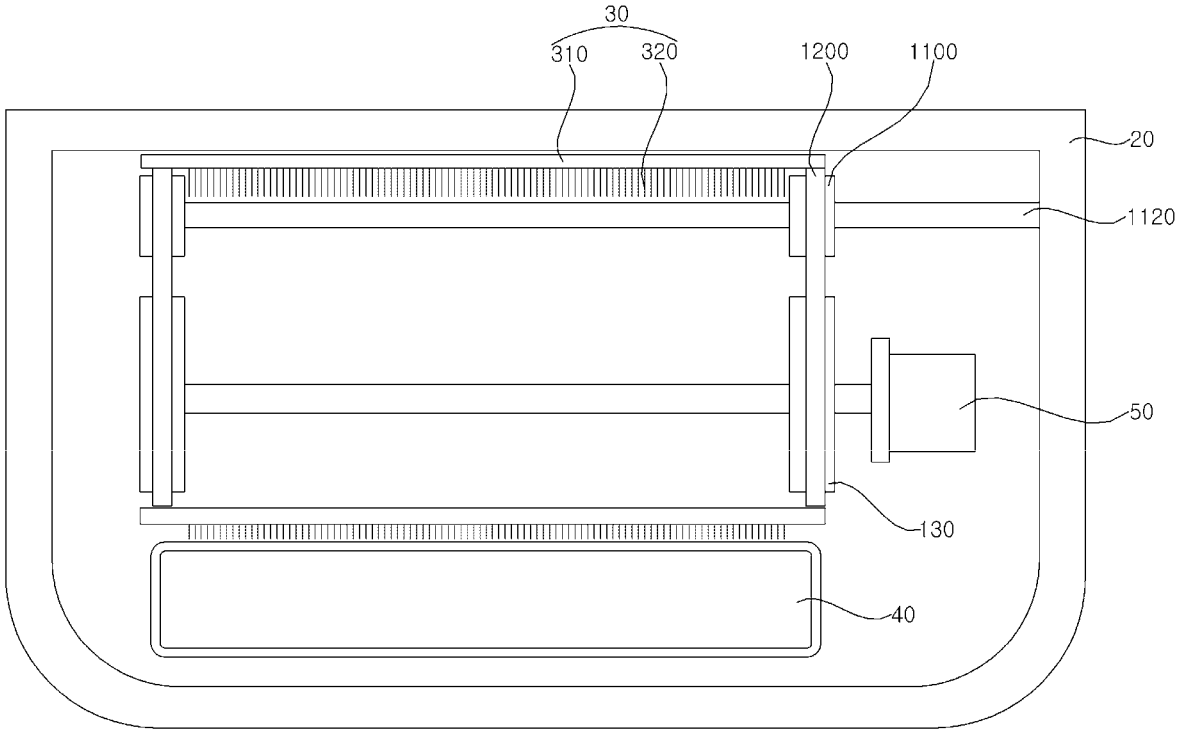
FIG. 10 is a schematic bottom view of a brush moving device of a cleaner according to a second embodiment of the present disclosure.
Figure 11:
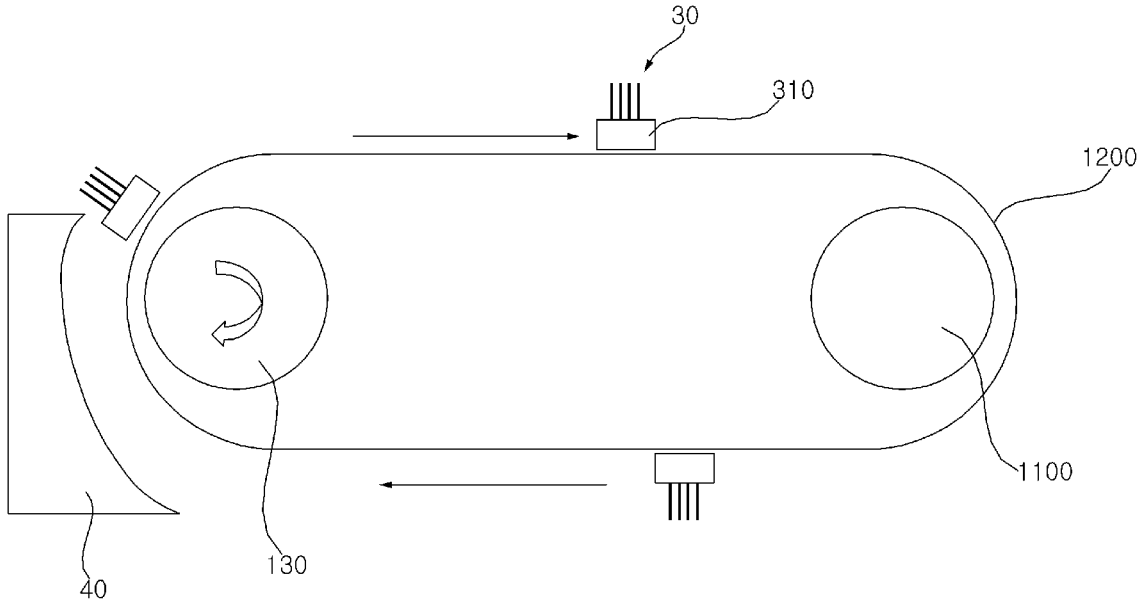
FIG. 11 is a side view schematically showing a process of a brush assembly and a power transmission member according to the second embodiment of the present disclosure.

A cleaner according to a second embodiment will be described with reference to FIGS. 10 and 11.

The cleaner according to the second embodiment includes a case 20, a brush assembly 30, an operation assembly 10, a suction port 40, and a motor 50, and the contents of the first embodiment are cited within a range not contrary to the first embodiment, and a description thereof will be omitted.

The operation assembly 10 of the second embodiment may include a roller 1100 at the front, and is connected to a power transmission member 1200 between the roller 1100 and the rotating member 130 to transmit power. A brush assembly 30 may be coupled to the power transmission member 1200.

The roller 1100 includes a roller rotating shaft 1120, and the roller rotating shaft 1120 may be connected to the case 20, and preferably connected to a side surface of the case 20.

The power transmission member 1200 may be formed of an elastic material, and may be a belt or a chain. The inner surface of the power transmission member 1200 is in contact with the rotating member 130 and the roller 1100, and the outer surface may be coupled with the brush assembly 30. Alternatively, the outer surface of the power transmission member 1200 may be coupled through the connecting body 332 or directly coupled to the brush bar 310.

Unlike the first embodiment, the operation method according to the second embodiment may include a roller 1100 in the front side of the case 20, and the power transmission member 1200 may be disposed between the rotating member 130 and the roller 1100 to transmit power of the motor 50 to the roller 1100. When the rotating member 130 connected to the motor 50 rotates, the power transmission member 1200 rotates, and the brush bar 310 or the connecting member 330 coupled to the outer surface of the power transmission member 1200 also rotates. Accordingly, the brush 320 may sweep away dust. The rotating member 130, the roller 1100 and the power transmission member 1200 may be disposed in both sides of the brush assembly 30 as shown in FIG. 10, but is not necessarily limited to the present description, and includes a change that can be easily performed by a person skilled in the art.

As described above, in the cleaner according to the present disclosure, since the brush performs only translational motion without rotational movement along the guide rail, the brush can be disposed only in one surface, there is an advantage of achieving a higher cleaning efficiency while using a much smaller number of brushes than the number of brushes installed in the entire cylindrical surface of the roller of the existing cleaner.

In addition, since the stroke distance of the brush can be increased merely when the brush performs a translational motion and the horizontal distance of the guide rail is increased, there is an advantage of being able to clean a much larger area than the area where a part of the outer circumferential surface of the roller of the existing cleaner is in contact with the floor.

In addition, the existing cleaner has a disadvantage in that a larger roller must be provided to clean a large area, and the height of the suction device is increased. However, the present disclosure does not include a roller, but can reduce the height of the suction device only by reducing the vertical height of the guide rail. Therefore, it has the advantage of being able to clean a narrow gap, as the height of the suction device is relatively low.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A cleaner comprising:

a case;

an opening formed in a lower side of the case;

a brush assembly disposed in the case, the brush assembly including a brush bar disposed horizontally and a brush coupled to the brush bar;

a suction port configured to suction dust collected by the brush assembly;

a motor configured to provide power to the brush assembly; and an operation assembly connecting the motor and the brush assembly and configured to convert a rotational movement of the motor into a translational motion of the brush assembly, wherein the operation assembly comprises:

a rotating member coupled to a shaft of the motor;

a link connected to the rotating member;

a connecting member connecting the brush bar and the link; and a guide rail configured to guide a movement of the connecting member in a longitudinal direction, and wherein the connecting member comprises:

a connecting body, the brush bar being coupled to an inner surface of the connecting body, the link being connected to an outer surface of the connecting body; and a protrusion protruding from the outer surface of the connecting body to a distal end, at least a part of the protrusion being inserted into the guide rail.

2. The cleaner of claim 1, wherein the guide rail comprises:

a rail side portion extending in the longitudinal direction;

an inner protrusion portion protruding towards the connecting body from an inner end of the rail side portion; and an outer protrusion portion protruding towards the connecting body from an outer end of the rail side portion.

3. The cleaner of claim 2, wherein the guide rail comprises:

a horizontal rail extending in the longitudinal direction; and at least one slope rail disposed at an end of the horizontal rail.

4. The cleaner of claim 3, wherein a connecting portion that connects the horizontal rail and the slope rail includes a curved portion.

5. The cleaner of claim 4, wherein the slope rail comprises:

a slope rail side portion;

an inner slope rail protrusion portion protruding towards the connecting body from an inner end of the slope rail side portion; and an outer slope rail protrusion portion protruding towards the connecting body from an outer end of the slope rail side portion.

6. The cleaner of claim 5, wherein the outer slope rail protrusion is connected to the curved portion at a connection point, and wherein a height of the connection point from a bottom of the outer protrusion portion of the guide rail is higher than a height of the inner protrusion portion of the guide rail from the bottom of the outer protrusion portion of the guide rail.

7. The cleaner of claim 3, further comprising a slope guide disposed adjacent a connection between the guide rail and the slope rail.

8. The cleaner of claim 7, wherein the slope guide comprises an elastic material.

9. The cleaner of claim 1, wherein the link comprises:

a first link having one end rotatably connected to the rotating member;

a second link having a first end rotatably connected to an opposite end of the first link and a second end rotatably connected to the connecting member; and a connecting pin configured to connect the first link and the second link, wherein the first link and the second link are configured to be folded towards each other by rotating at least one of the first link and the second link around the connecting pin.

10. The cleaner of claim 9, wherein the link further comprises a stopper configured to maintain an angle 0 between the first link and the second link to be less than 180 degrees.

11. The cleaner of claim 9, further comprising a spring disposed on the connecting pin and configured to provide a restoring force when displacement occurs between the first link and the second link.

12. A method of operating a cleaner comprising a case having an opening, a brush assembly having a brush bar and a brush, a suction port for suctioning dust collected by the brush assembly, a motor, an operation assembly connecting the motor and the brush assembly and converting a rotational movement of the motor into a translational motion of the brush assembly, and a guide rail for guiding and sliding the brush assembly, the method comprising:

sweeping dust by moving the brush assembly towards the suction port in a first direction;

raising the brush assembly along the slope rail of the guide rail to separate dust from the brush;

restoring the brush assembly by moving the brush in a second direction opposite to and parallel to the first direction; and lowering the brush assembly.

13. A cleaner comprising:

a case;

an opening formed in a lower side of the case;

a brush assembly disposed in the case, the brush assembly including a brush bar disposed horizontally and a brush coupled to the brush bar;

a suction port configured to suction dust collected by the brush assembly; a motor configured to provide power to the brush assembly; and an operation assembly connecting the motor and the brush assembly and configured to convert a rotational movement of the motor into a translational motion of the brush assembly, wherein the operation assembly comprises:

a rotating member coupled to a shaft of the motor;

a roller disposed at a front side of the rotating member; and a power transmission member having an inner surface surrounding the roller and the rotating member, and an outer surface coupled to a distal end of the brush bar.

* * * * *